United States Patent [19]

Yates, Jr.

[11] 4,387,828

[45] Jun. 14, 1983

[54] PLASTIC CONTAINER AND LID

[76] Inventor: George Yates, Jr., 151 Cumberland Rd., Glendale, Calif. 91202

[21] Appl. No.: 307,807

[22] Filed: Oct. 2, 1981

Related U.S. Application Data

[63] Continuation of Ser. No. 120,717, Feb. 11, 1980, abandoned.

[51] Int. Cl.[3] ..... B65D 41/18

[52] U.S. Cl. ..... 220/284; 220/306

[58] Field of Search ..... 220/306, 70, 355, 352, 220/356, 284, 66

[56] References Cited

U.S. PATENT DOCUMENTS

| | | | |
|---|---|---|---|
| 751,318 | 2/1904 | Maranville | 220/355 |
| 2,340,024 | 1/1944 | Skaller | 206/509 X |
| 3,272,383 | 9/1966 | Harvey | 220/66 |
| 3,329,302 | 7/1967 | Kitchen | 220/284 |
| 3,410,448 | 11/1968 | Hudson | 220/356 |
| 3,470,930 | 10/1969 | Jurczenia | 220/306 X |
| 3,480,195 | 11/1969 | Koboldt | 206/509 |
| 3,843,016 | 10/1974 | Bornhorst et al. | 220/306 |
| 3,912,109 | 10/1975 | Essex, Jr. et al. | 220/66 |
| 4,004,710 | 1/1977 | Crisci | 220/306 |
| 4,210,258 | 7/1980 | von Holdt | 220/306 |

FOREIGN PATENT DOCUMENTS

| | | | |
|---|---|---|---|
| 992475 | 7/1976 | Canada | 220/70 |
| 894007 | 4/1962 | United Kingdom | 206/509 |

*Primary Examiner*—Allan N. Shoap

*Attorney, Agent, or Firm*—Romney, Golant, Martin, Disner & Ashen

[57] ABSTRACT

A plastic container with a detachably connectable lid having the diameter and circumferential features of a conventional metal paint can is disclosed. The top section of the container includes a projection defining the top end of the wall of the middle section, a neck and an annular bead for engaging the lid. The lid includes an outer flexible leg that snaps over the neck and bead of the top section. The lid can be easily removed by inserting a screwdriver between the lid and the top section in a provided space and lifting the screwdriver. The bottom section of the container includes a projection defining the bottom end of the wall of the middle section, and with the lid are adapted to allow stacking of the container/lid combinations. The projection adjacent the top and bottom of the middle section of the container enable the container to be handled by labeling machinery used in conjunction with conventional metal paint cans.

3 Claims, 5 Drawing Figures

PLASTIC CONTAINER AND LID

This application is a continuation of application Ser. No. 120,717, filed Feb. 11, 1980, now abandoned.

BACKGROUND OF THE INVENTION

1. Field of the Invention

The present invention relates to a container, and in particular, to a resealable plastic container having a circumference like that of a conventional metal paint can.

2. Description of the Prior Art

Most paint is now sold in metal one gallon containers, these containers having a standard outer circumferential dimension, upper and lower bead placements and ear locations. Although the metal containers are sufficiently strong to carry paint they present several disadvantages. Firstly, these cans are expensive to fabricate, this disadvantage being further aggravated by the constantly increasing cost of metal. Secondly, metal cans dent easily, and since these paint cans are subject to rough handling during shipment and display they are frequently dented. After purchasing a can of paint the user must be careful not to drop it or otherwise bump it for fear that the container will be badly damaged or even rupture.

Thirdly, the metal containers do not reseal well since the metal used does not have a "memory." Frequently in attempting to open a paint can, its lid is bent or otherwise distorted. This makes resealing extremely difficult. In addition to the difficulty with deformations in the lid, the upper can geometry also creates undesirable disadvantages. The top of the conventional paint can contains an annular recess which accepts an annular ridge of the lid for sealing. Once the can is opened and used, paint invariably flows into the recess of the container each time a paint brush is dipped and removed. Not only is it difficult to put the lid back on the container tightly, but when the lid is replaced, the paint in the recess overflows and drips down the side of the can. The paint in the recess also sticks to the lid and dries which makes reopening difficult and further aggravates the difficulty of resealing the container after a second or later usage. Of course, without a good seal, the paint remaining in the can deteriorates causing unnecessary waste.

SUMMARY OF THE INVENTION

The invention consists of a unitary plastic container for carrying a product such as paint, comprising a middle section having a generally cylindrical shape with a generally constant thickness wall, a bottom section including a projection defining the bottom end of the wall of the middle section, an annular support surface and a concave center, and an upper section including a projection defining the top end of the wall of the middle section, a neck and an annular bead for engaging the lid.

It is an object of the present invention to provide a container that is less expensive to fabricate than a conventional metal container.

Another aim of the present invention is to provide a container that will not dent.

A further aspect of the present invention is to provide a container that reseals easily and effectively.

An additional object of the present invention is to provide a container with a lid that is easily engageable with and removable from the container.

Another object of the present invention is to provide a plastic container that is simple to construct and reliable in operation.

The foregoing objects, advantages, features and results of the present invention together with various other objects, advantages, features and results thereof which will be evident to those skilled in the art in light of this disclosure may be achieved with the exemplary embodiment of the invention described in detail hereinafter and illustrated in the accompanying drawings.

DESCRIPTION OF THE PREFERRED EMBODIMENT

Figure 1:
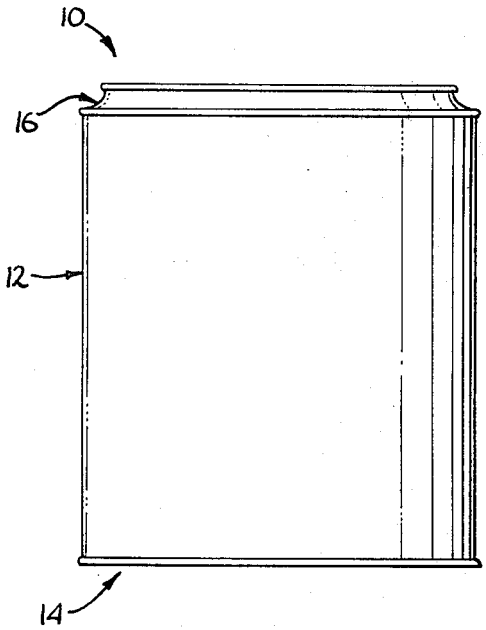
FIG. 1 is an elevational view of a container such as one that may be used to hold paint.

While the present invention is susceptible of various modifications and alternative constructions, an embodiment is shown in the drawings and will herein be described in detail. It should be understood, however, that it is not the intention to limit the invention to the particular form disclosed; but, on the contrary, the intention is to cover all modifications, equivalences, and alternative constructions falling within the spirit and scope of the invention as expressed in the appended claims.

The simplistic nature of the subject container can easily be seen by referring to FIG. 1, where there is illustrated a unitary plastic container 10 comprised of a substantially cylindrical middle section 12, a bottom section 14, and an upper section 16.

As mentioned, the present invention is ideally suited for use as a paint container and thereby it may replace the conventional metal paint can. Because of existing manufacturing processes, packaging machines and display habits it is important that this new generation paint container be constrained to certain dimensions. However, because plastic has different characteristics when compared to metal merely duplicating a metal can in plastic has not been commercially feasible. The container disclosed here allows use of existing processes, machines and display habits and yet has all the advantages plastic offers when compared to metal.

Because of the above constraints, the diameter of the middle section 12 is 6.65 inches which is the standard diameter of a one gallon metal paint can. To provide strength and reliability, the sidewall of the middle section is of a uniform thickness, approximately 0.06 inches.

The container (as well as the lid 32, FIGS. 3 and 4) are preferably formed from a suitable semi-rigid plastic having strength sufficient to withstand the abuses to which a container of this sort is subjected in normal use. Linear high density polyethylene is an especially suitable plastic material, although other plastics of the polyolefin or petrochemical family may be employed. An especially preferred plastic is polyethylene having a density range between 0.941 and 0.965 grams per cubic centimeter and a melt index between 0.1 and 9.0. Of course, as will be obvious to those skilled in the art, the container and lid may be constructed or fabricated from various other plastic material.

Figure 2:
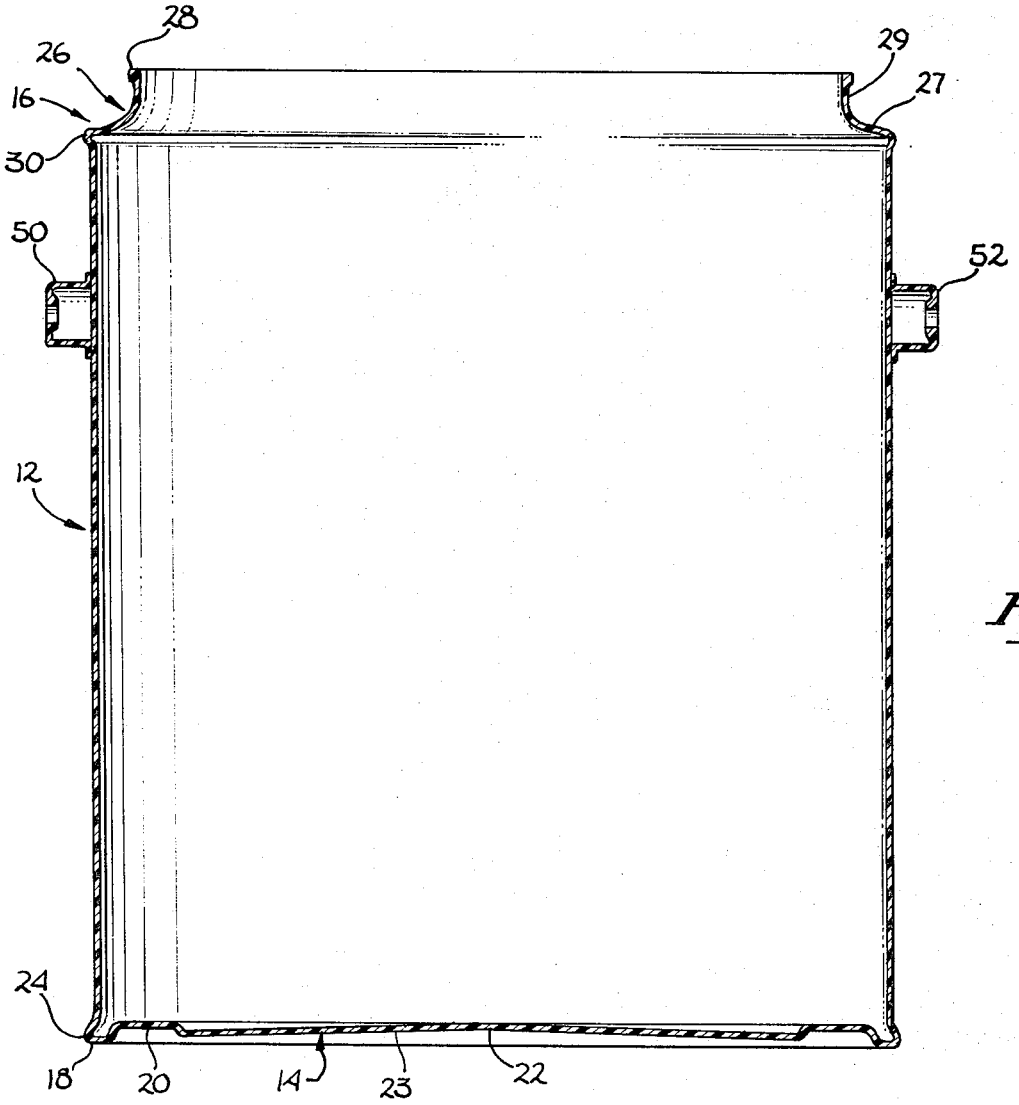
FIG. 2 is a sectional elevational view of the container in FIG. 1.

The bottom section of the container is constructed to facilitate stacking one container upon another. As can be seen best in FIG. 2, the bottom section 14 is generally concave and includes an annular support surface 18 which is formed immediately adjacent a perimetral projection 24. An annular recess 20 is also provided which lies in the same horizontal plane as a center point 22 of a generally concave center 23. The projection 24 defines the bottom end of the middle section 12 and, as will be discussed hereinbelow, defines the lower boundry of the surface upon which a label is placed.

Figure 4:
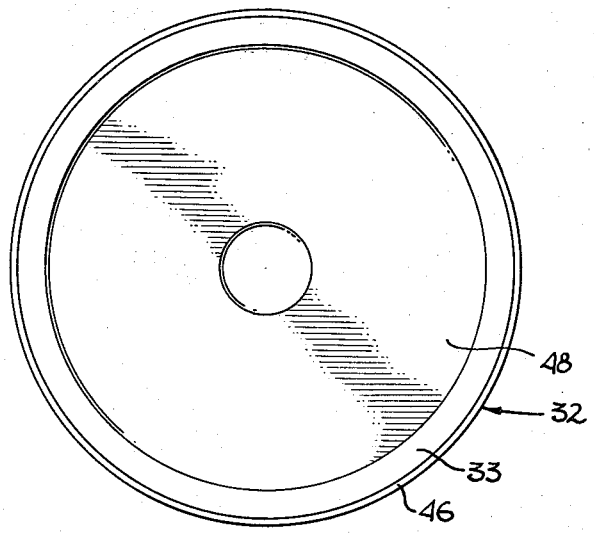
FIG. 4 is a plan view of the lid.

The upper section 16 of the plastic container is constructed to define the top end of the middle section and to provide means for lockingly engaging a lid 32, FIG. 4. It is to be noted that the upper section of the invention differs from the top of a conventional paint can and resolves many of its disadvantages. In particular, the annular recess found in the conventional paint can is absent. A neck configuration 26 is used instead of the annular ridge so there is no possibility of paint becoming trapped since the neck is comprised of a horizontal portion 27 and a vertical portion 29. The overall height of the neck in a preferred embodiment (i.e., for a one gallon paint container) is about 0.44 inches. The upper section 16 also includes a bead 28 thereupon. The bead is formed to releasably engage the lid in a locking arrangement without the provision of any recess or groove into which paint might fall or flow during use. On a very practical level, this is a major advantage over conventional paint cans.

The diameter of the bead 28 is less than the diameter of the middle section 12 and in the preferred embodiment is about 5.98 inches. The smaller diameter is achieved through the neck 26 which is formed in an upwardly sloped curve from a projection 30 to the bead 28. The slope of the neck with its horizontal and vertical portions provides strength and can be adjusted to provide whatever container volume requirements are to be met.

The projection 30 defines the upper boundry of the middle section in a manner analogous to the lower projection 24.

The lid 32 is constructed so that it may be easily engaged and disengaged from the container, and when engaged, to effectively lock and seal the container. The lid is also constructed to facilitate the stacking of one container upon another.

Figure 3:
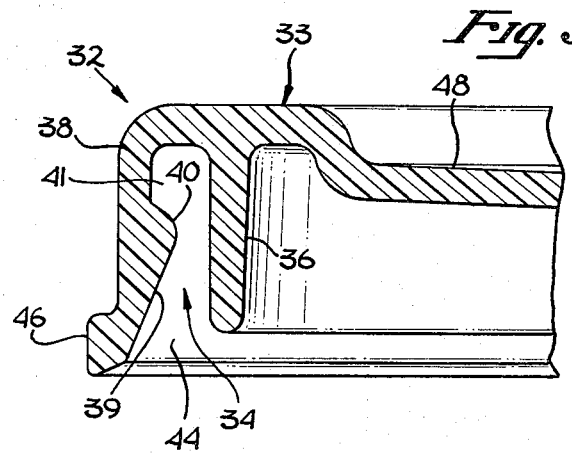
FIG. 3 is an enlarged sectional elevational view of a lid for the container of FIG. 1.
Figure 5:
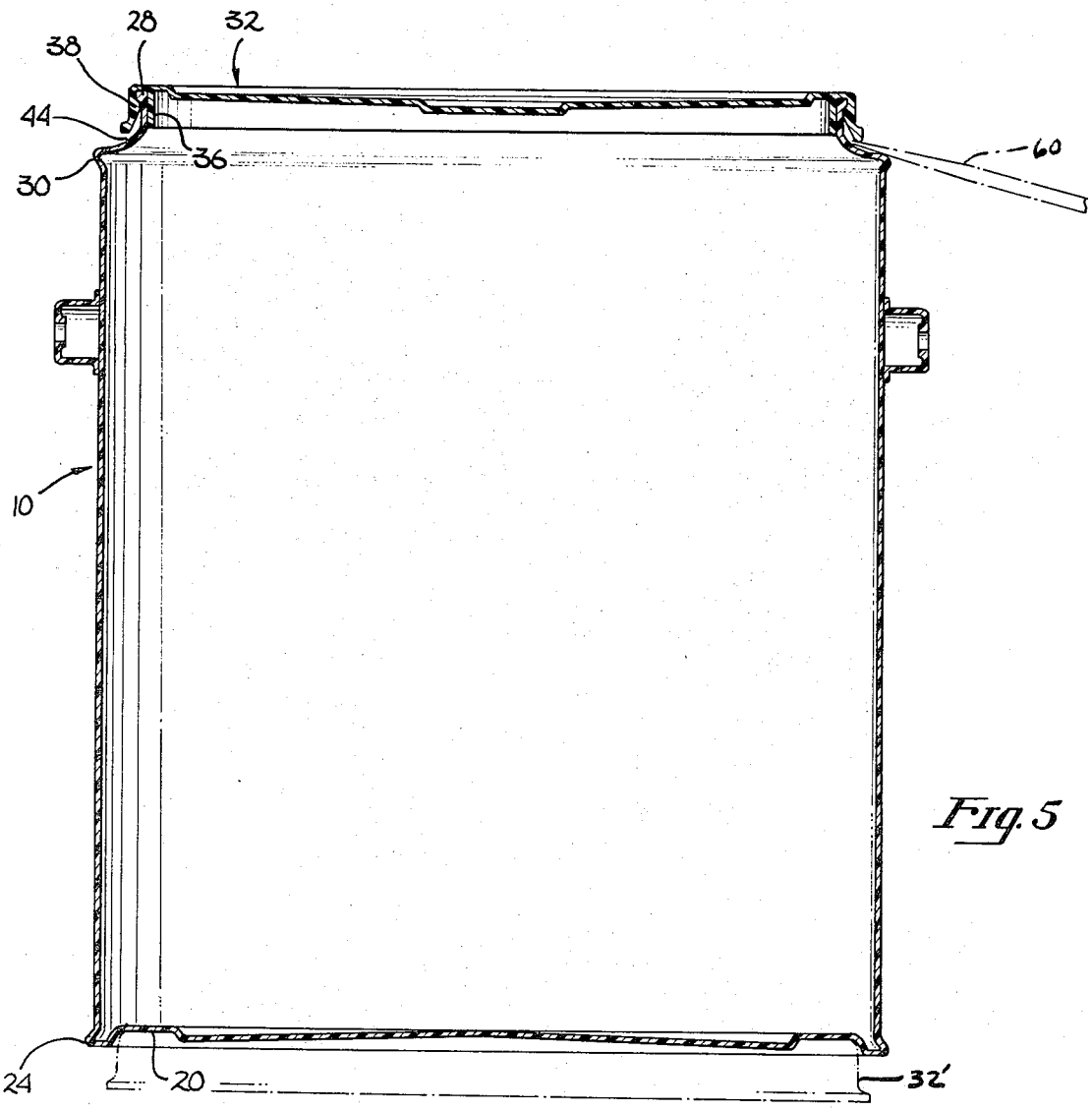
FIG. 5 is a sectional elevational view of the container with the lid engaged.

Referring now to FIG. 3, the lid 32 comprises an annular generally flat surface 33 and a channel 34. The channel 34 is formed by an interior annular strengthening wall 35 and a flexible annular leg 38. Between the wall 36 and the leg 38 is a space 41 for receiving the bead 28. The leg 38 has an inclined surface 39 forming a lip 40. When the lid is applied to the container the bead 28 will act as a cam along the surface 39 to flex the leg 38 outwardly. Once the bead reaches the lip 40, the leg will "snap" back to the position shown in FIGS. 3 and 5 and thereby lockingly engage the bead.

The surface 39 also extends away from the lip 40 to form an annular bead 46 at the end of the leg. Because of the slope of the surface 39 a space 44 is created to allow receipt of a tool, such as a screwdriver 60 (shown in phantom line in FIG. 5). By use of a tool the leg can be distorted to allow the bead 28 to slip out of engagement with the lip 40 and thereby allow removal of the lid from the container.

As best seen in FIG. 4, the flat surface 33 forms a boundry for a concave depression 48, and cooperates with the annular recess 20 of the container to allow stacking.

Referring once again to FIG. 2, two ears, 50 and 52 are attached to the middle section 12, such as by sonic welding. The ears are placed to receive the ends of a handle or bail by which a paint can is traditionally carried.

In operation, the lid 32 is sealably and detachably connected to the container 10 by placing the lid 32 over the container so that the bead 28 is positioned between the leg 38 and the interior wall 36. Pushing on the lid after it has been placed in this position causes the bead to force the leg to distend slightly allowing the bead to slide into the space 41. The leg snaps back into its normal position creating a lockingly engagement between the lid and the container. To remove the lid a screwdriver can be inserted into the space 44 and pulled upward so as to distend the leg and allow the bead to slip out of the space 41.

The annular recess 20 of the container and the surface 33 of the lid cooperate to facilitate the stacking of one container upon another. The phantom outline at the bottom of FIG. 5 displays how a lid of an adjoining container fits into the annular recess of the container to allow a stacking engagement.

As mentioned earlier, the projections 24 and 30 form the lower and upper boundries of the middle section of the container (approximately 7.2 inches apart). These boundries as well as the placement of the ears 50 and 52 (about 5.86 inches from the support surface 18) are the keying features used by conventional labeling or printing machines. By locating these keying features in a manner identical to those on a metal can, handling of the preferred embodiment container can proceed without change from existing practices. Also, because the diameter of the preferred embodiment is the same as conventional cans, packaging is essentially the same as is transportation to and display at the retail level.

What has been described is a superior synthetic resin container which is ideally suited to obsolete the conventional one gallon metal paint container. The plastic container of the present invention is easy to construct, reliable in operation and relatively inexpensive. In addition, the present invention will not dent like a metal can nor have the dripping and resealing problems which are notorious problems with conventional metal paint cans.

What is claimed is:

1. A plastic container and detachably disposed lid in combination, (a) said container including a middle section having a cylindrical shape with a generally constant wall thickness; a bottom section integral with said middle section and including a projection defining the bottom part of said middle section;

an upper section integral with said middle section and including a projection defining the top part of said middle section wherein said middle section and the first and second mentioned projections are congruent with the outer dimensions of the wall and the location of the upper and lower beads of a conventional one-gallon metal paint container; said upper section also includes an integral neck having a wall portion directed upwardly and inwardly and a straight vertical wall portion in which the inner surface of the vertical wall portion is cylindrical having no projections, recesses or slanted surfaces, said neck terminating with an annular bead, wherein said upwardly and inwardly directed wall portion and said vertical wall portion have a constant wall thickness of approximately the same dimension as the wall thickness of said middle section; and (b) said lid having an annular, generally flat surface, a recessed middle portion, and a perimetral flexible leg including an internal lip for engaging the bead of said upper section, said lid when placed on the container being disposed such that the end of the leg at the lowest portion of the lid is spaced above and substantially inwardly of the projection defining the top part of the middle section so that the major portion of said upwardly and inwardly directed wall portion below said leg is viewable when viewing said upwardly and inwardly directed wall portion in a horizontal plane when said container is in an upright position, said projection of said upper section serving as a fulcrum for a tool used to remove the lid from the container by inserting an end of the tool under the leg and pivoting the tool at the projection, said leg being spaced from said vertical wall portion below the engagement of said internal lip and said bead with the spacing gradually increasing as the distance from said engagement increases.

2. A container as claimed in claim 1 wherein:

the inward disposition of said neck is approximately five times the wall thickness of said middle section.

3. A container as claimed in claim 1 wherein:

the diameter of said middle section at an inner wall is 6.43 inches;

the diameter of the inner wall at the annular bead is 5.78 inches; and the wall thickness of said middle section is approximately 0.06 inches.

* * * * *